United States Patent [19]

Dougherty

[11] 4,305,413

[45] Dec. 15, 1981

[54] CLEANING APPARATUS

[75] Inventor: Francis J. Dougherty, Jenkintown, Pa.

[73] Assignee: Ecology, Inc., Montgomeryville, Pa.

[21] Appl. No.: 172,310

[22] Filed: Jul. 25, 1980

[51] Int. Cl.[3] ..... B08B 3/04

[52] U.S. Cl. ..... 134/90; 134/102; 134/107

[58] Field of Search ..... 134/84, 88–90, 134/94, 102, 105, 107

[56] References Cited

U.S. PATENT DOCUMENTS

| | | | |
|---|---|---|---|
| 934,331 | 9/1909 | Merrill | 134/84 |
| 2,334,232 | 11/1943 | Wells | 134/102 X |
| 2,651,191 | 9/1953 | Barnes | 134/94 X |
| 3,657,990 | 4/1972 | Wilhelm | 134/102 |
| 3,799,179 | 3/1974 | Thomas | 134/102 X |
| 3,884,250 | 5/1975 | Beesley | 134/88 |

*Primary Examiner*—Robert L. Bleutge

*Attorney, Agent, or Firm*—Seidel, Gonda, Goldhammer & Panitch

[57] ABSTRACT

The cleaning apparatus includes a pre-rinse tank, a cleaning tank, and at least one post-rinse tank. The cleaning tank cleans oil, flux and other foreign matter off the surface of a work product by subjecting the work project to a rising stream of bubbles of uniform density which overflow the upper end of a chimney and return to the bottom end of the chimney. The bubbles are created by porous chambers internally pressurized with a gas such as air. The post-rinse tank is likewise constructed so as to subject the work product to a rising column of bubbles having uniform density across the width of the post-rinse tank but without any recirculation of the rinse liquid.

8 Claims, 4 Drawing Figures

FIG. 3
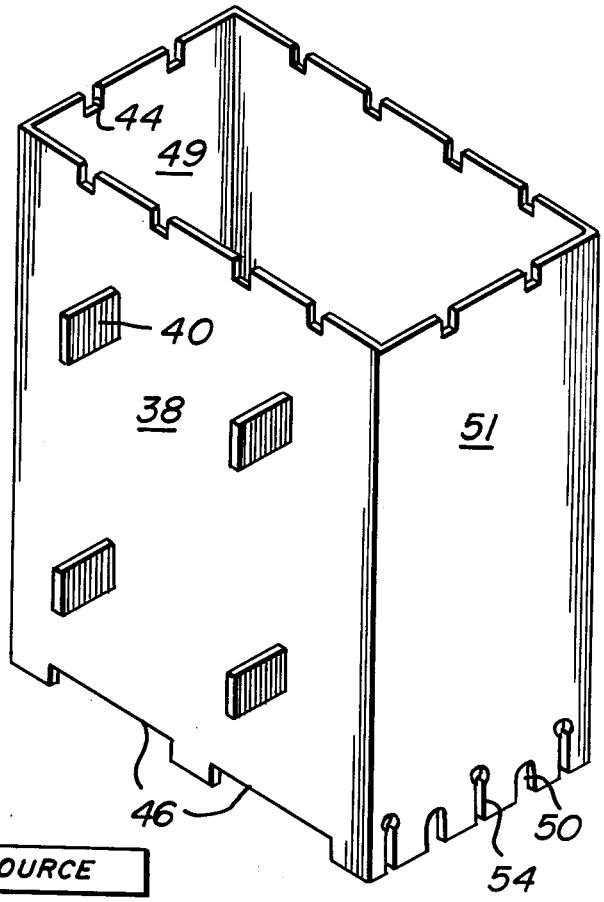
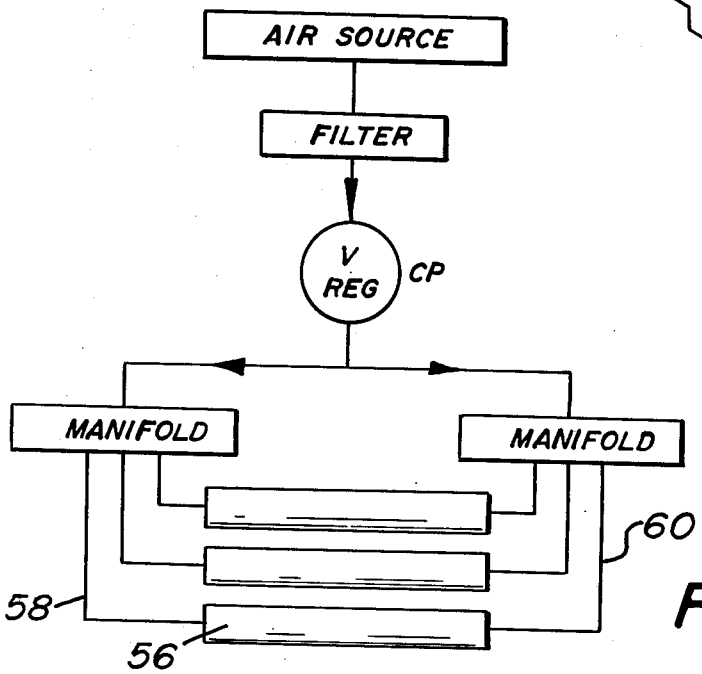
FIG. 4

CLEANING APPARATUS

BACKGROUND

It is known to create bubbles exhibiting the phenomena of cavitation by use of ultrasonics. It is known to clean work products by subjecting them to a degreasing vapor in a degreasing tank. To induce cavitation ultrasonically in a tank, the tank must of necessity be quite small, otherwise the ultrasonics become quite complex and expensive. Large degreasing tanks using hydrocarbon solvents constitute a possible health hazard since the solvent vaporizes and escapes to the surrounding atmosphere.

The present invention is directed to a comparable apparatus which facilitates larger sizes of work products to be cleaned while at the same time produces no contamination or ecological problem.

SUMMARY OF THE INVENTION

The cleaning apparatus of the present invention is preferably comprised of a series of tanks, namely a pre-rinse tank, a cleaning tank, and at least one post-rinse tank. The pre-rinse tank includes means for rinsing a work product to remove foreign matter off the surface of the products. The cleaning tank includes a chimney assembly therewithin. The chimney assembly is spaced from the side walls of the cleaning tank so as to provide therebetween a space. The chimney assembly is open at its open and lower ends so that liquid may flow in a closed circuit. A means including porous gas chambers are provided adjacent the bottom of said chimney assembly for creating gas bubbles in the liquid within the cleaning tank and with the bubbles of uniform density across the width of the chimney assembly. The bubbles rise and overflow the upper end of the assembly and enter said space for return to the bottom of the chimney assembly. Conduit means are provided for introducing a pressurized gas into the chambers for discharge into the chimney assembly through a porous wall of the chambers. A work product support means is provided within the chimney assembly so that a work product will be in contact with the rising bubbles.

The post-rinse tank is similar to the cleaning tank in that it includes similar means for creating bubbles in the same manner as described above in connection with the cleaning tank. However, the rinse tank does not involve a closed circuit of flowing liquid but rather is an open circuit whereby a liquid such as water is introduced into the bottom of the rinse tank, rises upwardly in the form of a stream of bubbles, and discharges through an outlet.

It is an object of the present invention to provide novel cleaning apparatus wherein a cleaning tank subjects a work product to rising bubbles of substantially uniform density across the width of a chimney assembly for uniform overflow from the upper end of the chimney assembly and return to the bottom of the chimney assembly.

It is an object of the present invention to provide apparatus for cleaning metal parts for removal of oils, fluxes and the like by subjecting the parts to a rising column of bubbles.

It is another object of the present invention to provide cleaning apparatus of an aqueous nature which is adapted for accommodating a detergent for cleaning metal work products which can have numerous niches and crevices to be cleaned.

It is another object of the present invention to provide apparatus for cleaning products such as printed circuit boards which are cleaned in a manner which does not present any ecological or health problem to workers.

Other objects will appear hereinafter.

For the purpose of illustrating the invention, there is shown in the drawings a form which is presently preferred; it being understood, however, that this invention is not limited to the precise arrangements and instrumentalities shown.

FIG. 3 is a perspective view of the chimney.

FIG. 4 is a diagrammatic illustration of circuitry.

DETAILED DESCRIPTION

Figure 1:
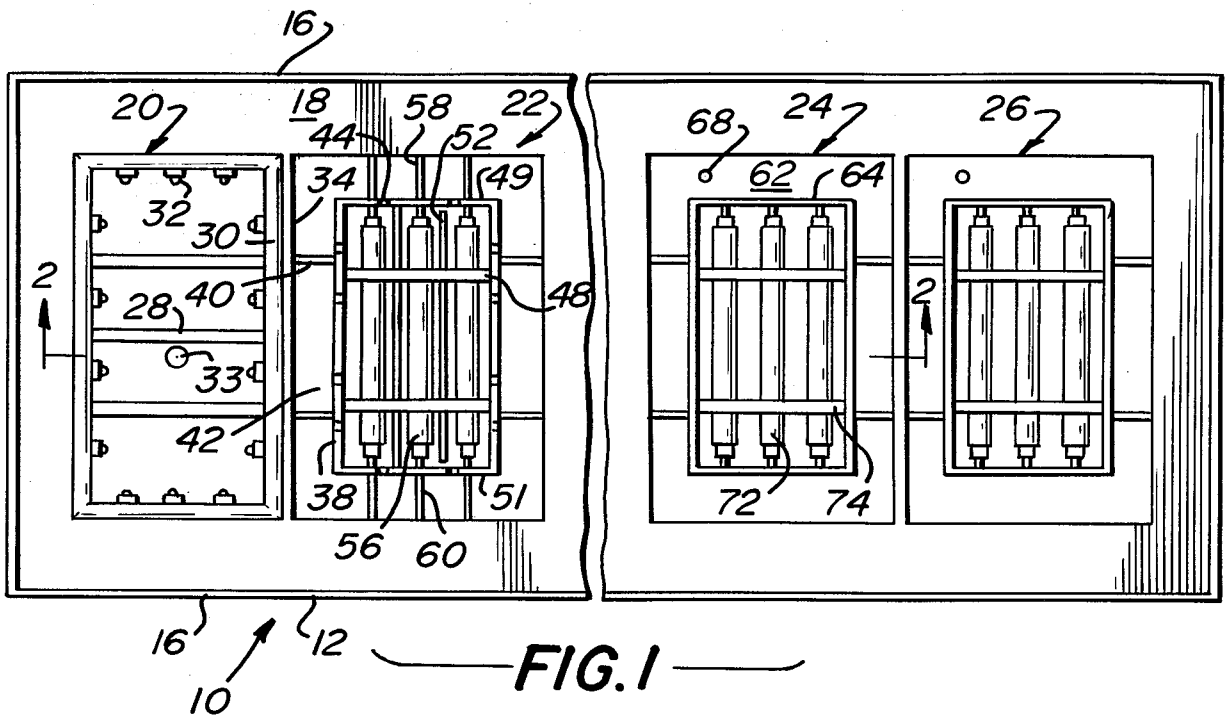
FIG. 1 is a top plan view of apparatus in accordance with the present invention.
Figure 2:
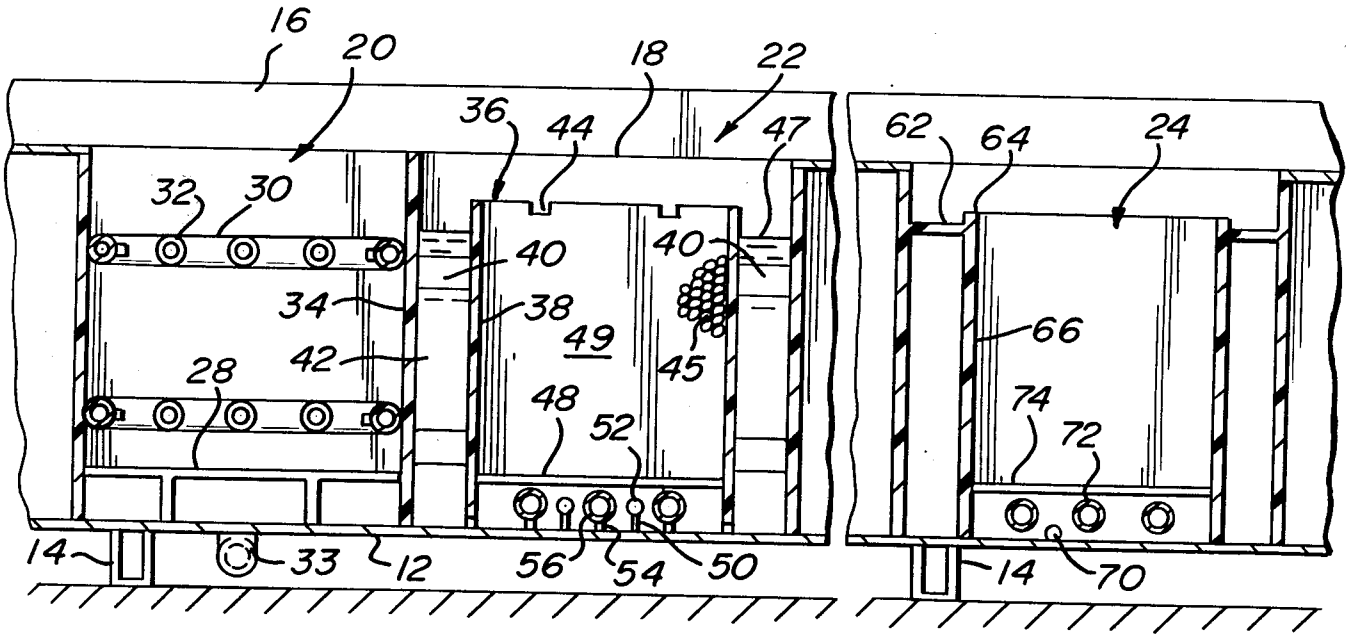
FIG. 2 is a sectional view taken along the line 2—2 in FIG. 1.

Referring to the drawings in detail, wherein like numerals indicate like elements, there is shown in FIG. 1 apparatus in accordance with the present invention designated generally as 10. The apparatus 10 includes in the preferred embodiment a housing designated generally as 12 and made from a non-corrosive material capable of withstanding heat up to 160° F. and requiring low maintenance. Housing 12 is preferably made from polypropylene. Other equivalent materials may be used for the housing 12. Housing 12 is preferably provided with legs 14 as shown in FIG. 2. The housing 12 preferably has a peripheral ledge 16 projecting upwardly around the entire periphery of a top wall 18. In the top wall 18, there is provided a plurality of cut-out areas containing tanks extending downwardly therefrom and within the housing 12. Thus, there is provided a pre-rinse tank designated 20, a cleaning tank 22, and at least one post-rinse tank. In the preferred embodiment, there is provided a pair of post-rinse tanks designated 24 and 26.

The pre-rinse tank 20 includes a work support near the bottom thereof for supporting work products to be cleaned. Within the pre-rinse tank 20, there is provided at least one pipe 30 extending around the entire periphery of the tank and having inwardly directed nozzles 32 for discharging a spray of rinse water. Within the pre-rinse tank 20, surface contaminants and other foreign matter are removed from the surface of the work product. The supply pipe for supplying water to the pipes 30 is not illustrated. The outlet from the pre-rinse tank 20 is designated 33.

The cleaning tank 22 is separated from the pre-rinse tank 20 by a partition wall 34. Within the tank 22, there is provided a chimney assembly designated 36. The chimney assembly 36 is discrete and readily removable from the tank 22. Assembly 36 includes a chimney 38 which is preferably rectangular and open at both ends. See FIGS. 2 and 3. The peripheral dimensions of chimney 38 are smaller than that of the inside of tank 22 so as to provide a space 42 between the vertical walls of chimney 38 and the vertical walls of tank 22. Spacers 40 may be provided on the chimney 38 so that opposite side walls of the chimney 38 are equally spaced from the vertical walls of the tank 22.

Referring to FIG. 3, the chimney 38 is notched on its upper periphery as indicated by the notches 44. Notches 44 are provided to facilitate an even overflow of cleaning liquid in the form of bubbles 45 which overflow the upper edge of the chimney 38 and become a part of the liquid in the space 42. The upper surface of the liquid in space 42 is designated 47.

The notches 44 should not be arbitrarily placed. By empirical testing, I have found that the notches 44 should have an area of about ¼ of a square inch for every 6 inches of linear length of the peripheral walls of the chimney 38. The pattern of notches 44 shown in FIG. 3 corresponds to the pattern on a chimney whose end walls are approximately 13 inches long and whose side walls are approximately 22 inches long. There is a limitation on the height of the chimney 38 since it is desired to have an even overflow of bubbles 45 from the upper edge of the chimney 38. If the chimney 38 were to have a height of 10 feet with side and end walls dimensioned as set forth above, the bubbles 45 would dissipate before they reached the upper edge of the chimney 38. With end and side walls dimensioned as set forth above, a preferred height for the chimney 38 is approximately 28 inches. Chimney 38 is preferably made from materials comparable to that described above in connection with the housing 12. In order that the bubbles 45 do not elevate the chimney assembly 38, it may be weighted or hold-down brackets may be provided.

As shown more clearly in FIG. 3, the bottom edge of the side walls of the chimney 38 are provided with notches 36. The width of the notches 36 are unimportant. I have found that the height of the notches 46 should not be more than about ¾ inch for a chimney 38 dimensioned as set forth above. When the notches have a height less than about ¾ inch, there is insufficient return flow of water to the bottom of the chimney 38. When the height of the notches 46 is increased substantially above ¾ inch, the bubbles 45 exit from the notches 46 into the space 42.

A work support 48 is provided within the chimney 38. At an elevation below the elevation of the work support 48, each of the end walls is provided with a plurality of notches. Referring to FIG. 3, end wall 51 is provided with a pair of notches 50. The notches 50 facilitate accommodating a pair of electrical heaters 52 below the elevation of the work support 48. Wiring is connected to the heaters 52 by way of the notches 50. The entire chimney 38 may be elevated and removed from the cleaning tank 22 without disturbing the heaters 52. The heaters 52 are utilized when the water within the tank 22 contains a detergent. The heaters are of variable temperature adjustable within the range of 120°–150° F. When certain types of detergents are utilized, and no heaters are provided, the detergent will form bubbles which will overflow the entire tank 22. When heated within an appropriate temperature range between about 120° and 160° F., the detergent performs its function of removing oils from the work product without interfering with the bubbles 45 which perform a scouring function. In connection with this disclosure, the word detergent is used broadly to include all types of surfactants.

As shown in FIG. 3, end wall 51 is provided with three slots 54. Slots 54 accommodate the air supply conduits 58 and 60 connected to the opposite ends of chambers 56. The air supply conduits 58 and 60 are connected to nipples that are force-fit into the ends of the chambers 56. The chambers 56 are preferably cylindrical chambers made from a porous crystalline high density polyethylene for forming bubbles having a maximum size of about 60 microns when filled with filtered pressurized air at a pressure of 14–16 psi. The preferred air flow rate is 1 cubic foot per minute per 12 inches of length of said chambers 56.

A preferred material for the chambers 56 are cylindrical tubes sold commercially by Glasrock Products Inc. of Fairburn, Ga. under the trademark "POREX". I have found that the pressure of the air introduced into the chambers 56 by way of the conduits 58, 60 must be carefully controlled since below 14 psi no bubbles 45 are produced in the water. When the pressure is above 16 psi, the bubbles produced in the water are too large and immediately coalesce with one another to form larger bubbles which produce no scouring action. While the chambers 56 could be constructed so as to produce smaller size bubbles such as 20 microns, their lifespan in actual use would be very short since such small flow passages in the porous material would rapidly clog due to impurities and foreign particles in the air stream introduced into the chambers by way of the conduits 58, 60.

The chambers 56 are provided in a sufficient number so as to generate bubbles 45 of uniform density across the width and length of the chimney 38 so as to avoid laminar flow of bubbles. I have found that chambers 56 in the form of tubes having an outer diameter of 1½ inches and an inner diameter of 1 inch should be located approximately on 4 inch centers.

The rinse tanks 24 and 26 are identical. Hence, only tank 24 will be described in detail. Tank 24 is similar to cleaning tank 22 to the extent that there is provided a plurality of porous chambers 72 below a work support 74 within the tank walls 66. The tank walls 66 project upwardly beyond the top wall 62 so as to define a rim 64. The top wall 62 is at an elevation below the elevation of the housing wall 18 and includes an outlet overflow drain 68. Rinse water is introduced into the tank 28 by way of the inlet 70 at a rate of approximately 1 gallon per minute. The water is converted into a rising column of bubbles of uniform density across the width of the tank 24, the bubbles overflow the rim 64, and then discharge by way of the outlet 68. The rinse water may be deionized or otherwise treated where hard water is a problem or where stringent cleanliness is required.

PREFERRED METHOD OF USE

For cleaning work products such as printed circuit boards containing oil and fluxes, the apparatus 10 as utilized as follows. Water is at the level 47 and includes a detergent for converting the flux on the circuit boards to soap. Heaters 52 are operating at an appropriate temperature such as 140° F.

The circuit boards are supported by an open mesh tray positioned on the support 28 for a pre-rinsing within the pre-rinsing tank 20. Surface foreign matter, water soluble oils and the like are removed from the circuit boards in the tank 20. Thereafter, the tray of circuit boards is placed onto the work support 48. As shown in FIG. 4, air or some other gas under pressure is filtered and regulated by a constant pressure regulator valve to 14–16 psi and then by way of manifolds enters the conduits 58, 60. The inert gas or air discharging through the porous chambers 56 creates small bubbles 45 of uniform density across the length, width and height of the chimney 38. The bubbles rise upwardly and scour the printed circuit boards. The detergent is converted into similar bubbles which removes any surface oils and converts the flux on the printed circuit boards into soap. The mixture of soap bubbles and the aqueous bubbles 45 overflows the upper edge of the chimney 38 and mixes with the water in space 42 which surrounds the chimney 38.

As the column of bubbles 45 moves upwardly and overflows the upper edge of the chimney 38, water from the space 42 enters the bottom of the chimney 38 by way of the notches 46 to thereby provide a closed circuit. In a working embodiment, space 42 has a width of about 2 inches.

After being cleaned in chamber 22 for a residence time of about 3 to 5 minutes, the circuit boards are then removed and placed onto the work support 74. Rinse water is converted into a vertical column of bubbles as described above by the porous chambers 72. The bubbles overflow the rim 64 and discharge through the outlet 68. After a residence time of about 1 to 2 minutes, the circuit boards are removed from the chamber 24 and placed in the chamber 26 where the circuit boards are rinsed in a similar manner.

The cleaning and scouring action of the bubbles 45 is believed to be similar to that attained by cavitation induced into a liquid by ultrasonic energy. The above-described parameters of the chimney 38 have been arrived at by empirical testing. Chimney 38 should be at least 12 inches high but its height should be no more than 1½ to 2 times its largest transverse dimension. The chambers 56 and 72 should be spaced from one another as described above to avoid a laminar column of bubbles 45. The chimney 38 should be notched as described above and the air pressure regulated so as to obtain small bubbles 45 of uniform density across the length and width of the chimney 38. Since the cleaning liquid in tank 22 is water or an aqueous solution of a detergent or flux cleaner, there is no health hazard to workers. If desired, the cleaned circuit boards may be placed in an oven for rapid drying.

The present invention may be embodied in other specific forms without departing from the spirit or essential attributes thereof and, accordingly, reference should be made to the appended claims, rather than to the foregoing specification, as indicating the scope of the invention.

I claim:

1. Cleaning apparatus including a cleaning tank for use in connnection with a pre-rinse tank and/or at least one post-rinse tank wherein the cleaning tank includes a chimney assembly, said chimney assembly being disposed within the cleaning tank in a manner so that a space is provided between the side walls of the cleaning tank and side walls of the chimney assembly, said chimney assembly including a chimney which is open at its upper and lower ends so that liquid may be circulated in a closed circuit which includes said space, means including a plurality of gas chambers adjacent the bottom of said chimney assembly for creating gas bubbles in the liquid in the chimney with the bubbles being of uniform density so that bubbles flow upwardly and overflow the upper end of the assembly and enter said space where they dissipate and return as a liquid to the bottom of the chimney, conduit means for introducing pressurized gas into said chambers for discharge into the chimney through a porous wall of the chambers, and means for supporting a work product in said chimney above the elevation of said chambers so that the work product will be in contact with the rising bubbles.

2. Apparatus in accordance with claim 1 wherein a rinse tank is provided adjacent the cleaning tank, the rinse tank having a work support therein, a plurality of gas chambers in the rinse tank below the elevation of the work support therein, conduit means for introducing pressurized air into the chambers for discharge through a porous wall of the chambers for creating bubbles in the rinse tank, a water inlet to the rinse tank, an upper rim on the rinse tank over which bubbles may overflow in a uniform manner, and a discharge outlet for discharge of bubbles overflowing the rim.

3. Apparatus in accordance with claim 1 or claim 2 wherein said chimney is rectangular in section, said chimney having a height of at least 12 inches, the upper edge of said chimney having a notch in every 6 inches of periphery, the bottom end of said chimney having notches not higher than about ¾ inch to facilitate return of water from said space to the interior of said chimney.

4. Apparatus in accordance with claim 1 wherein said porous chambers are constructed so as to generate bubbles having a maximum size of about 60 microns, a source of air pressure in the range of 14 to 16 psi with an air flow rate of 1 cubic foot per minute per each 12 inches of length of said chambers.

5. Apparatus in accordance with claim 4 wherein said chambers are cylinders, three such cylinders being provided in spaced parallel relation within said chimney.

6. An article of manufacture for use in a cleaning tank comprising a chimney assembly, said chimney assembly including a chimney which is open at each end, the upper end of said assembly being uniformly notched, the lower end of said assembly having notches not greater than about ¾ inch in height, said chimney having a height of at least 12 inches, a work support within said chimney adjacent the lower end thereof, a chamber means within said chimney below the elevation of said work support for creating bubbles in a cleaning liquid in a manner so that bubbles will be of uniform density across the length and width of the interior of the chimney, and conduit means for introducing pressurized gas into opposite ends of said chamber means for discharge through a porous wall of the chamber means.

7. An article of manufacture in accordance with claim 6 including at least one heater within said chimney below the elevation of said work support.

8. An article in accordance with claim 6 wherein said chamber means includes a plurality of uniformly spaced parallel tubes of porous material.

* * * * *